United States Patent [19]

Cecchi

[11] Patent Number: 4,485,858

[45] Date of Patent: Dec. 4, 1984

[54] CUTTER ARBOR HAVING HELICOIDAL CUTTERS FOR WOOD PLANING MACHINES

[76] Inventor: Gianfranco Cecchi, Via Ressi, 34/A, 20125 Milano, Italy

[21] Appl. No.: 482,290

[22] Filed: Apr. 5, 1983

[51] Int. Cl.[3] ..... B27G 13/00

[52] U.S. Cl. ..... 144/221; 144/117 R; 407/42; 407/63

[58] Field of Search ..... 144/117 R, 218, 230, 144/221; 407/52, 63, 36, 37, 38, 39, 41, 42

[56] References Cited

U.S. PATENT DOCUMENTS

| | | | |
|---|---|---|---|
| 369,785 | 9/1887 | Gleason | 144/221 |
| 811,768 | 2/1906 | Forbes | 144/221 |
| 1,395,309 | 11/1921 | Taber | 407/52 |
| 3,672,017 | 6/1972 | Nielsen et al. | 407/63 |

*Primary Examiner*—W. D. Bray

*Attorney, Agent, or Firm*—Young & Thompson

[57] ABSTRACT

In a cutter arbor for wood planing machines, continuous flexible non-adjustable pre-ground cutters, to be thrown away after wear, are inserted into helicoidal slots of the arbor itself. These disposable cutters are characterized in that they are thin and of constant cross section throughout their length. They are bowed and have a convex longitudinal edge and a concave longitudinal edge that are parallel to each other. The cutting edge is the convex longitudinal edge. In their undeformed condition, the cutters are uniplanar. The cutters have a cross-sectional area of about 10–15 mm×1–1.5 mm, and a radius of the bowed configuration of about 1 m.

3 Claims, 6 Drawing Figures

CUTTER ARBOR HAVING HELICOIDAL CUTTERS FOR WOOD PLANING MACHINES

BACKGROUND OF THE INVENTION

The present invention relates to a cutter arbor, having helicoidal cutters, for wood planing machines, which allows solving in a practical and economical manner the problem of the rational equipment of wood planing machines with cutting tools.

It is known that, at present, wood planing machines make use of a cutter arbor having rectilinear cutters, adjustable for regrinding, with the cutting edge parallel to the rotation axis of the arbor itself. Such cutters are fixed on the arbor with locking wedges and abutment screws in prismatic slots provided on the cutter arbor.

In the accompanying drawings, FIG. 1 is a perspective view of the arbor of a common wood planing machine, with a cutter inserted therein, while FIG. 2 is a cross-section of said arbor. These figures show the cutter arbor, a cutter, the lock wedge, the locking abutment screws, and the springs which facilitate the removal of the cutters when they have to be reground. In this construction, the cutters may be adjusted, provided that the cutting edges thereof are always kept on the same working diameter (a constructive and functional conception which has been widely adopted in the modern wood planing machines), and to allow the widest possible use of the cutters with regrinding, before their replacement.

With this arrangement, the regrinding can be carried out on the arbor itself through an appropriate grinder fitted on the planing machine, or else separately in the tool maintenance department of a workship. In the first case the grinding is usually more expensive, but more precise; in the second case the grinding is less expensive, but it is more difficult and it takes longer to lock the cutters on the arbor in such a precise position as to get all the cutting edges to work on the same diameter.

A cutter arbor as that heretofore described and illustrated in FIGS. 1 and 2 of the accompanying drawings, has the serious drawback of being quite noisy, both in the idle condition—because of the air being swirled by the cutters and hitting simultaneously, throughout the arbor length, the stationary surfaces close to the arbor (siren effect)—and, above all, during the cutting operation, when each single cutter hits the wooden board being planed throughout its width. This drawback—already widely felt in the field concerned—has lately become more serious due to the fact that, as is known, also for the machines involved, limits of upper sound level have been set by the international antipollution rules. The industries concerned have thus had to work out solutions to this problem.

Although many solutions have been proposed, only one of them has proved to solve the problem: the one adopting helicoidal cutting edges.

In this sense, two main lines have been followed: the first one provides for the use of rigid continuous helicoidal cutters, adjustable for regrinding and fixed to the arbor with the same system adopted for the rectilinear cutters, the lock wedges being also helicoidal; the second one adopts cutters in several portions, with the cutting edge parallel or slanting in respect of the arbor axis, arranged on the arbor itself in helicoidal sequence. This second solution is obtained with small cutters, which are adjustable for regrinding and fixed onto the cutter arbor either directly, or by axially connecting annular cutter-bearing elements, offset in a helicoidal direction, which carry small cutters of the type adjustable for regrinding, or else preground and not adjustable, to be thrown away when worn.

Neither of the two aforementioned solutions has however found practical use on a wide scale, for the followinng reasons.

Continuous helicoidal cutters:

They involve considerable costs in that, being rigid (cross sectional area of $3 \div 4$ mm$\times 30 \div 35$ mm, as for rectilinear cutters), they have to be helicoidally shaped and, therefore, accurately machined to observe the helicoidal geometry.

They are difficult to adjust for regrinding in that, as the tool comes out, there is no longer any correspondence between the helicoidal geometry of the cutter and those of the wedge and of the prismatic slot of the arbor (the contacting surfaces as a result having different curvatures).

They must practically be reground on the cutter arbor with a very long operation, which is not easy as it has to be carried out under dry conditions and with special procedures, on account of the helicoidal shape.

Cutters in several portions:

They are easier to construct in that, even if positioned slanting in respect of the arbor axis, they are flat (on account of their limited length, the cutting angle varies only slightly), but their regrinding—whether carried out on the arbor, or out of it—is very long and toilsome, as can easily be appreciated.

The drawbacks of regrinding are overcome when pre-ground cutters are thrown away after wear, but in this case the overall cost becomes prohibitive, on account of the large number of cutters required for covering the whole arbor (order of magnitude: 40 cutters).

SUMMARY OF THE INVENTION

With this state of the art, to overcome the drawbacks which have been illustrated above, the present invention provides an arbor with helicoidal cutters, which clearly differs from the known ones and provides a relatively economical and very practical solution to the afore examined problems connected with wood planing machines. The said arbor is essentially characterized in that, continuous flexible non-adjustable pre-ground cutters, to be thrown away after wear, are inserted into helicoidal slots of the arbor itself. More precisely, the cutters have a flat constant cross-section, they bend in the direction of the largest moment of inertia of said section and they are widely flexible both in the direction of thhe smallest moment of inertia of the section and in torsion.

BRIEF DESCRIPTION OF THE DRAWINGS

The invention will now be described in further detail, by more way of example, with reference to the accompanying drawings, in which.

DESCRIPTION OF THE PREFERRED EMBODIMENTS

Figure 1:
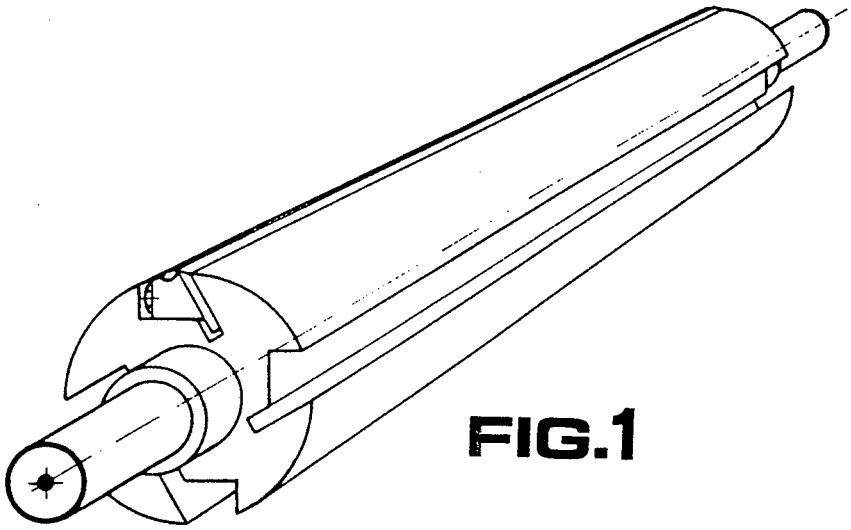
FIGS. 1 and 2 represent, as already heretofore specified, a cutter arbor for planing machines according to the prior art most in use.
Figure 2:
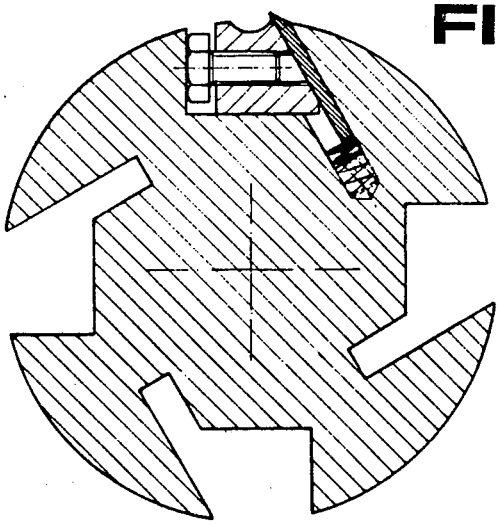
Figure 3:
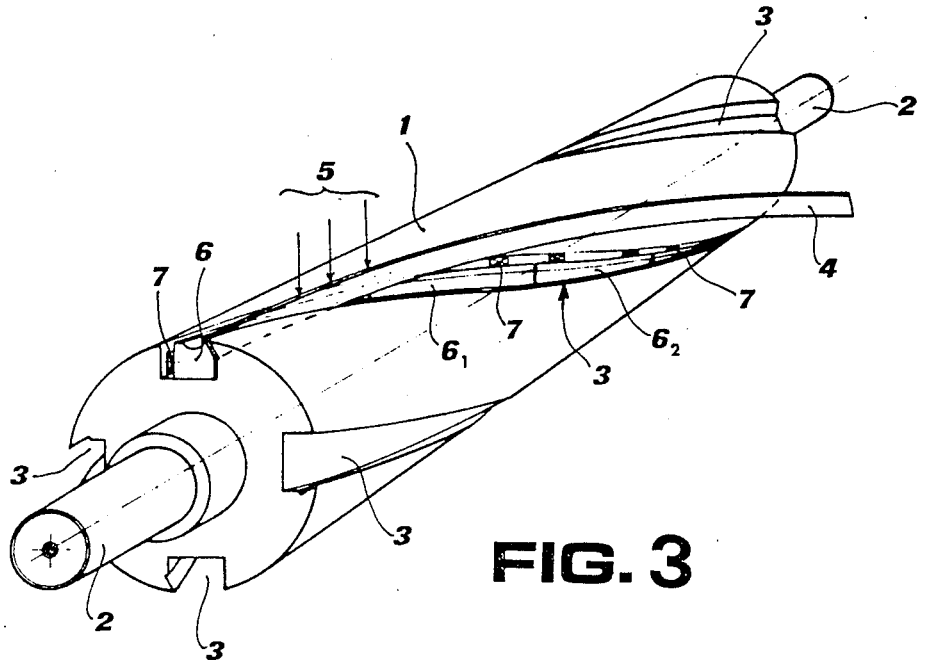
FIG. 3 is a perspective view of a cutter arbor for planing machines, according to the present invention, showing some slots without the cutter and one slot with the cutter partially inserted therein.
Figure 4:
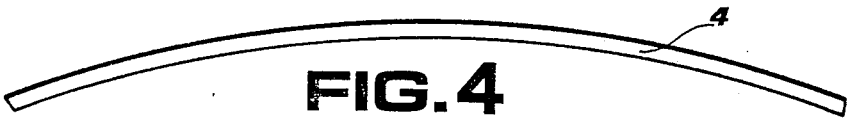
FIG. 4 is a front view of an expendable flexible cutter, to be inserted in the arbor according to the invention, shown in FIG. 3.

With reference to the drawings (FIGS. 3 to 6), the arbor according to the invention is formed as a large cylindrical body 1 surrounding a pin 2 of smaller diameter. A number of helicoidal slots 3—for instance four slots, according to the drawing—are provided on the body 1. Each of said slots houses an expendable flexible cutter 4, which is inserted by pressing inward in a radial sense, as indicated by the arrows 5. The cutter 4—better illustrated in FIG. 4—is formed like a portion of a circular crown, having a rather narrow flat constant cross-section—for instance, 10–15 mm high and 1–1.5 mm thick—and being made of steel, of the type usually adopted for this kind of tool.

Thanks to its structure, the cutter 4 has great flexibility in the direction of the smallest moment of inertia of the section, as well as great torsional flexibility. As it would be impossible to bend it as far as would be required for its correct insertion into the slots 3 of the body 1, in the direction of the largest moment of inertia of its section, its structure is curved—as illustrated and as already explained—with a constant curvature, to fit into the slots 3, i.e. with bending radiuses of the order of one meter.

The cutter 4 is conveniently produced from rectilinear steel strip, preferably by performing the operations of: constant radius bending; chamfering of an edge (which may also be done before bending); hardening of the chamfered edge; grinding; cutting to length. It has however been found that, with some particular types of steel, the curvature can also be conveniently performed as a last operation, immediately before the cutting to length.

In general, use can be made of ordinary steel strips found on the market, which should provide the flexibility sufficient for insertion into the slots 3 of the arbor body 1. On the other hand, if the designer were to choose, for the arbor, slots having a particularly marked helicoidal design, it will also be possible to use steels adapted to stand a slight permanent deformation, or to provide for a hardening of the sole cutting edge of the cutters, so that they may stand a slight permanent deformation both during insertion thereof into the arbor and, previously, to facilitate said insertion. In any case, the cost of these cutters is low, as can easily be gathered from what has been said.

Figure 5:
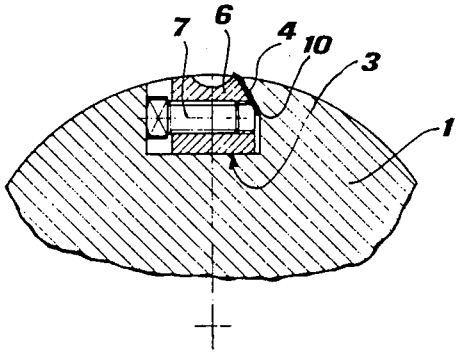
FIG. 5 is a cross section view of the arbor according to the invention, shown in FIG. 3, illustrating a system for fixing the cutters into the arbor.
Figure 6:
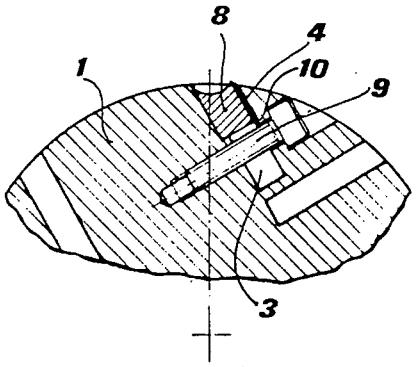
FIG. 6 is a section view similar to that of FIG. 5, showing a second system for fixing the cutters into the arbor of the invention.

The fixing of the cutter 4 into the slots 3 of the body 1 of the arbor according to the invention can be carried out in various ways; for instance, in a very simple way, as indicated in FIGS. 5 and 6. In the first case, a common helicoidal wedge 6 with abutment screws 7 is used for the locking; in the second case, a block 8 is positively locked with screws 9.

If the solution of FIG. 5 is adopted, the wedge is preferably formed of more pieces ($6_1$, $6_2$, in FIG. 3), in order to reduce its production cost (in fact, in this way, the elements $6_1$, $6_2$, . . . of the wedge can be obtained with die-cast dural, with sintered steel, or with other techniques which require no machining and are thus economical).

If the solution of FIG. 6 is adopted, the block 8 can also be all in one piece, without incurring unacceptable costs, since in this case it can be obtained from a drawn member, by bending. This can also be done for the solution of FIG. 5, if the cross section of the wedge 6 is not too wide.

When the cutters 4 of the arbor according to the invention are worn, they can be replaced by new cutters with an extremely simple and quick operation, which merely requires the loosening of the screws 7 or 9, the extraction of the worn cutter 4 to be thrown away, the insertion of the new cutter 4 in a radial sense—which is very easily carried out—and the locking thereof in a suitable position, by tightening the screws 7 or 9. It should be noted that the insertion of the cutter in a suitable position, which is correct and requires no adjustments, is guaranteed by the fact that the width of the cutters is standardized and that the slots 3 comprise a stop 10, against which bears the bottom of the cutters when they are inserted.

With a cutter arbor according to the invention and the cutters therefor described hereabove, all the problems concerning this important component of wood planing machines are thoroughly and conveniently solved, in that:

The noise of the machine—in the idle as well as in the operating condition—is considerably reduced, equally as if the most complex and costly system of rigid helicoidal cutters were adopted, but at the same time:

owing to the relatively easy flexure and torsion of the cutter during insertion thereof into the cutter arbor, this operation can be carried out manually in an easy and convenient manner;

for a specific deformation, the cutter is scarcely stressed, so as not to be damaged during insertion thereof into the slots of the arbur.

The construction and pregrinding of the cutter are highly economical, thanks to its shape which, instead of being helicoidal, is flat with a slight curvature on the actual plane of the cutter.

It should be observed that the limited cost of the cutter (which is to be thrown away after wear), is essential for the operational economy of the planing machine, taking into account the fact that each arbor is normally provided with two to six cutters (or even more).

I claim:

1. In a cutter arbor for wood planing machines, comprising a cylindrical arbor having helicoidal slots in its cylindrical surface and cutters removably disposed in said slots; the improvement in which said cutters are continuous flexible cutters which in their undeformed condition are uniplanar and of constant cross-sectional configuration throughout their length and are bowed so that they have a convex longitudinal edge and a parallel concave longitudinal edge, said convex edge being a cutting edge.

2. A cutter arbor as claimed in claim 1, in which said cutters have cross-sectional dimensions of about 10–15 mm×1–1.5 mm, and a radius of the bowed configuration of about 1 m.

3. A cutter arbor as claimed in claim 1, and fixed stops at the bottoms of said slots, against which said concave edges of the cutters bear.

* * * * *

UNITED STATES PATENT AND TRADEMARK OFFICE

CERTIFICATE OF CORRECTION

PATENT NO. : 4,485,858

DATED : December 4, 1984

INVENTOR(S) : Gianfranco CECCHI

It is certified that error appears in the above—identified patent and that said Letters Patent is hereby corrected as shown below:

On the title page;
In the heading, recite the claim to priority of Italian patent application No. 20762 A/82, filed April 15, 1982.

Signed and Sealed this

Sixth Day of August 1985

[SEAL]

*Attest:*

DONALD J. QUIGG

*Attesting Officer* *Acting Commissioner of Patents and Trademarks*